United States Patent [19]

Sing

[11] Patent Number: 4,671,384

[45] Date of Patent: Jun. 9, 1987

[54] WINDOW ESCAPE DESCENT CONTROL DEVICE

[76] Inventor: Peter Sing, 43 Donny Brook Rd., Scarsdale, N.Y. 10583

[21] Appl. No.: 902,499

[22] Filed: Sep. 2, 1986

[51] Int. Cl.[4] ..... A62B 1/08

[52] U.S. Cl. ..... 182/231; 182/239

[58] Field of Search ..... 182/5–8, 182/231, 234, 236, 71, 233, 239

[56] References Cited

U.S. PATENT DOCUMENTS

| | | | |
|---|---|---|---|
| 639,455 | 12/1899 | Spalding | 182/236 |
| 643,286 | 2/1900 | Feiker | 182/236 |
| 3,880,255 | 4/1975 | Huntley | 182/5 |
| 4,088,201 | 5/1978 | MacFarlane | 182/5 |
| 4,287,963 | 9/1981 | Coxsey | 182/236 |
| 4,399,889 | 8/1983 | Todd | 182/6 |
| 4,437,546 | 3/1984 | Marinoff | 182/5 |
| 4,611,688 | 9/1986 | Sekhar | 182/232 |
| 4,654,464 | 12/1986 | Dixon | 182/5 |

*Primary Examiner*—Reinaldo P. Machado
*Attorney, Agent, or Firm*—Nathaniel Altman

[57] ABSTRACT

The window escape descent control device for emergency use from upper windows of tall buildings comprises a body harness supported on the end of a rope wound around a flanged spool. The spool, when turned by the unwinding rope pulled by the weight of an escaper in the body harness, turns the shaft and an electrical generator operatively mounted thereon. The shaft also carries, and is controlled by, an electromagnetic brake and a speed control governor, which may be either centrifugally or optically operated and which, when a predetermined rate of shaft rotation is reached, causes energy to be released from the generator to actuate and apply the brake to the shaft; thus the rate off all of the escaper cannot exceed a pre-selected maximum.

The mechanism is mounted on a frame support structure straddling and depending from the escape window ledge. The frame strucutre provides hand and foot support to aid the escaper in climbing out the window and in getting into position for descent. Means for rewinding the rope onto the spool for another escape descent from the same window is also provided.

9 Claims, 7 Drawing Figures

WINDOW ESCAPE DESCENT CONTROL DEVICE

FIELD OF THE INVENTION

This invention relates generally to window escape means, and more specifically, to a mechaism for providing safe escape and controlled descent from windows of the upper floors of tall buildings.

BACKGROUND OF THE INVENTION

The tragedy of people being trapped on the upper floors of tall buildings, unable to be helped or to escape from the mortal dangers of fire, smoke, poisonous fumes and the like, occurs all too frequently. Innumerable lives might be saved by having available a simple-to-use device which would permit a person to lift a child over, or to climb himself over the ledge of a high window and to be lowered safely to the ground at an automatically controlled rate of speed. Even more lives might be saved if the mechanism could be restored for subsequent escape and descent by another from the same window.

It is the principal object of this invention to provide just such a life-saving apparatus which is safe, easy to use, practical, inexpensive, adjustable for mounting on any window ledge and collapsible for convenient storage.

SUMMARY OF THE INVENTION

The window escape descent device of this invention comprises a collapsible support frame, adjustably securable to any window ledge. The frame supports a descent control mechanism and at the same time provides hand grips and foot supports for helping the escaper make his way through the window and into position for descent. The descent control mechanism comprises a body harness supporting the escaper around the waist and upper body, leaving arms and legs free; the body harness is suspended on a rope of sufficient length to reach the ground, wound around a spool coaxial with, and mounted for one-way simultaneous rotation on, a shaft also carrying an electric generator and an electromagnetic brake. As the escaper in the body harness releases his hold on the support frame and begins to descend, the rope unwinds by turning the spool and its shaft, the rotation of which starts to charge the generator; as the speed of descent by gravity increases, the generator creates more power; when a predetermined maximum speed is reached, a speed control governor (activated either centrifugally or optically) closes the circuit between the generator and the electromagnetic brake. The brake is thereby applied in order to avoid a further increase in the speed of rotation of the shaft beyond the pre-selected maximum, thus stabilizing the rate of descent, regardless of the weight or size of the escaper. In the final stage of the descent, as the ground approaches, the speed is reduced still further to ensure an injury-free landing by a reduction of the diameter at one end of the spool where the last portion of the rope has been stored and is now unwinding. Means for rewinding the rope back onto the spool after an initial descent is provided, so that a second escaper may use the same route to safety.

The structure and concepts of this invention will now be detailed in connection with the accompanying illustrative drawings, wherein:

SHORT FIGURE DESCRIPTION OF DRAWINGS

DESCRIPTION OF THE PREFERRED EMBODIMENTS

Figure 1:
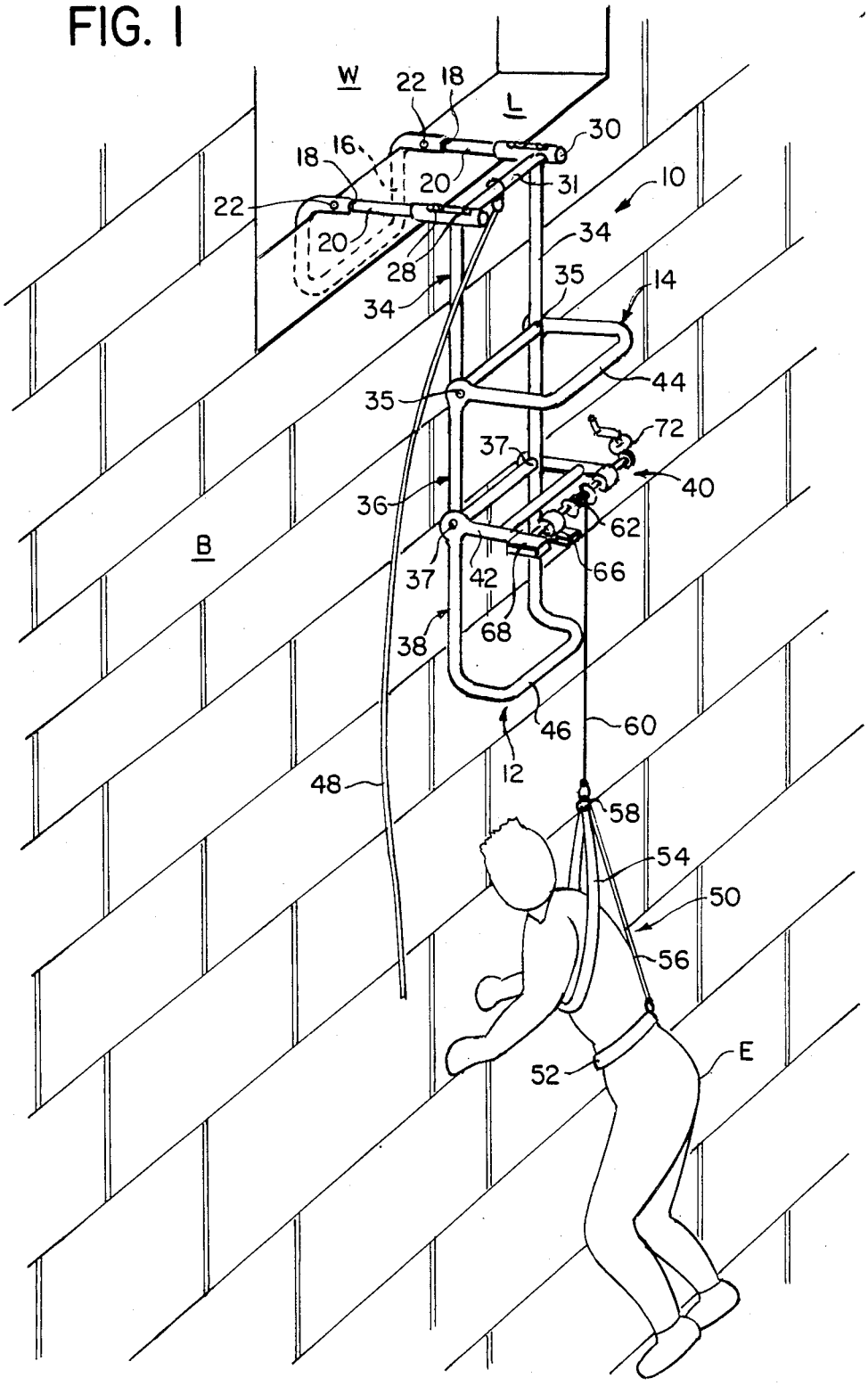
FIG. 1 is a perspective view of a preferred embodiment of this invention shown in use.
Figure 3:
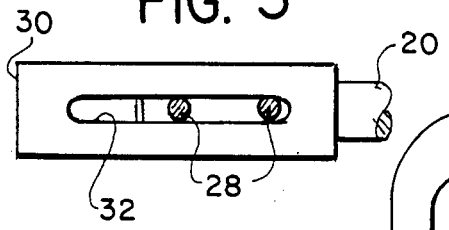
FIG. 3 is a sectional view taken along line 3—3 of FIG. 2.
Figure 2:
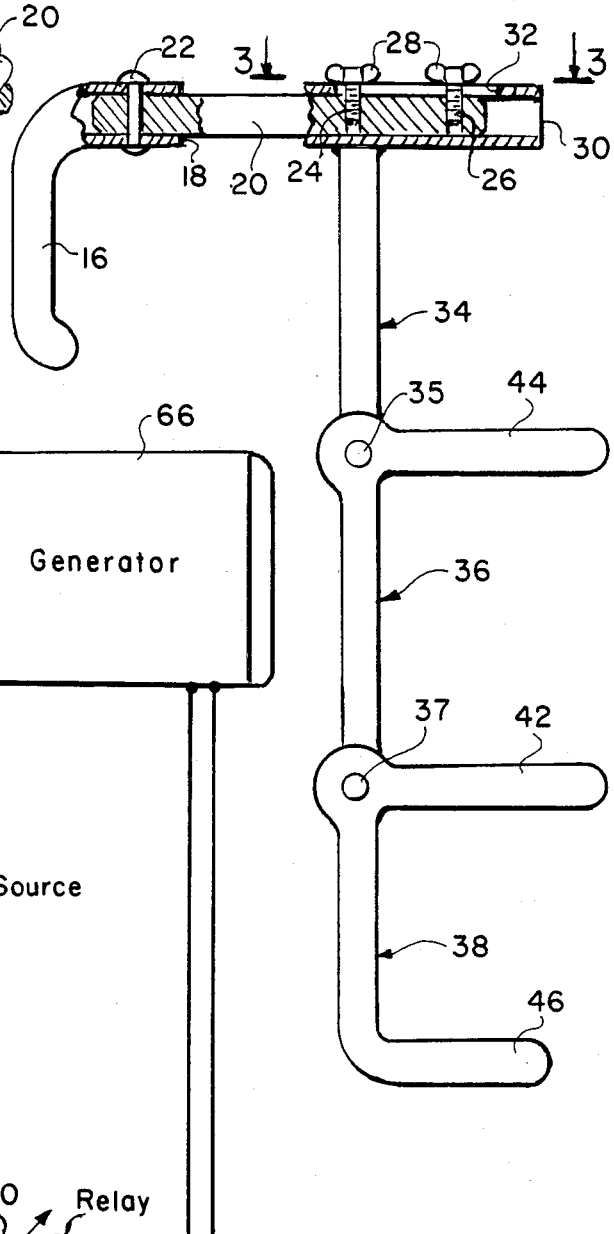
FIG. 2 is a side elevational view, partly broken away, of the support structure of FIG. 1.

Referring to FIGS. 1–3, building wall B is shown with upper window opening W accommodating, and window ledge L supporting, the descent control device generally designated 10. The support structure 12 of descent device 10 comprises an adjustable collapsible frame 14 which has at its upper end a vertically disposed U-shaped depending hollow-tubing section 16, which serves as anchor for device 10 by hanging inside and against window ledge L. Tubing section 16 is bent at its upper ends to form outwardly projecting, horizontally disposed sockets 18,18, which fixedly hold a pair of solid rods 20,20, riveted in place at 22,22. Rods 20,20 extend outwardly across window ledge L and at their forward ends, each rod 20 is threadedly bored at 24 and 26 to accommodate wing bolts 28 (Fig. 2). A pair of cylindrical sleeves 30,30 are attached to each other by cross-bar 31, and each sleeve has an adjustment slot 32, through which each sleeve 30 is held on its corresponding rod 20 by wing bolts 28; sleeves 30,30 each carry a vertically disposed tube 34, held firmly against building wall B by the positioning adjustment of sleeves 30,30 on rods 20,20 by means of slots 32 and wing bolts 28.

The lower ends of tubes 34 are attached pivotally at 35,35 to ladder-like extension member 36, extending downwardly to be joined pivotally to second extension member 38 at 37. Member 38 provides mounting for descent speed control mechanism 40 on horizontally extending upper support 42. Cross-bars 44 on extension 36 and 46 on extension 38 serve as hand grips and foot supports to aid escaper E in emerging from window W and maneuvering into position for descent, also aided by guide rope 48 suspended from from cross-bar 31.

As seen in FIG. 1, escaper E is supported for descent by harness 50, which comprises waist belt 52, carrying connecting rope 54 and upper body loop support 56. Rope 54 and support 56 are held by connecting ring 58 and thereby are suspended from, and supported by, main descent rope 60 which is wound on flanged spool 62 of descent control mechanism 40. It is understood that other body support means, for example a seat support, might be used in place of body harness 50.

Figure 4:
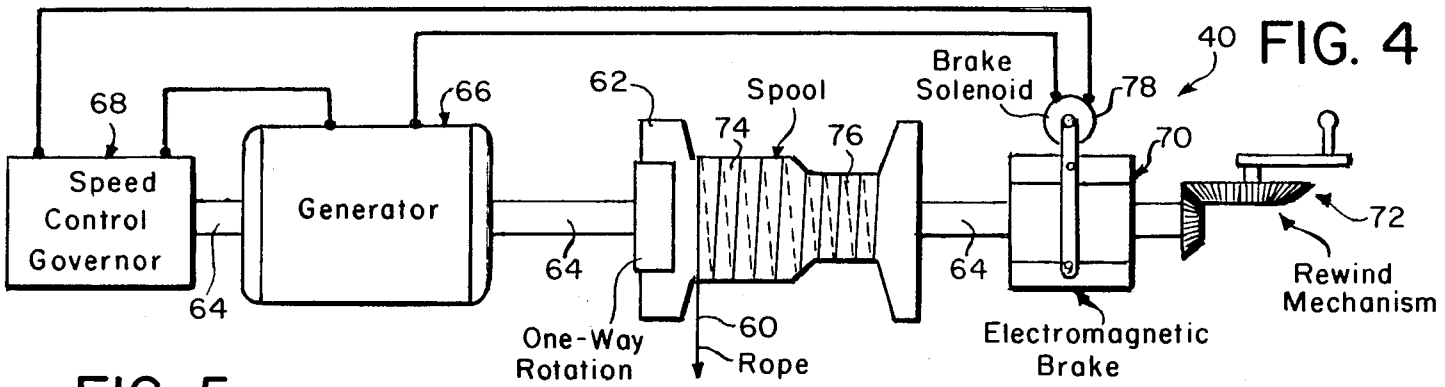
FIG. 4 is a schematic view of the speed control descent mechanism of FIG. 1.

FIG. 4 shows flanged spool 62 mounted on, and for rotation with, shaft 64, which carries similarly mounted generator 66, speed control governor 68, electromagnetic brake means 70 and rewind mechanism 72. Rope 60 is so wound on spool 62 that the left side, as seen in FIG. 4, unwinds first, from the spool's larger diameter portion 74; as escaper E approaches the ground, rope 60 continues to unwind from smaller diameter portion 76, whereby, with the revolutions per minute kept at the maximum designated speed by governor 68 (hereinafter described) and with rope 60 unwinding a shorter length per revolution of spool 62, the descent is slowed to an extent measured by the ratio of diameters 74 and 76. Flanged spool 62 is provided with one-way rotation control 78, which may be in the form of a ratchet-and-pawl or other known clutching arrangement (not shown), so that shaft 64 will be rotated only when spool 62 is turned by the downward pull of rope 60.

The operation of generator 66 in producing electrical energy begins when 64 is first rotated by the falling weight of escaper E released from support structure 12 and causing rope 60 to turn spool 62. As the speed of descent increases, the rate of energy produced by the generator becomes greater. A maximum allowable descent rate has been pre-set in speed control governor 68, which, when that speed is reached, closes the circuit between generator 66 and solenid 78 of electromagnetic brake 70. Brake 70 is thereby applied to shaft 64 to maintain the speed of rotation and consequently the rate of fall of escaper E, at or below the pre-set maximum speed.

Rewind mechanism 72 is provided to permit a second escaper to rewind rope 60 on spool 64 and to recover harness 50 which escaper E has released on the ground. Bevel gear 73, mounted on shaft 64, may be turned by mating gear 75 by manual rotation of handle 77. Rope 60 will thereby be rewound on spool 62 by the rotation of shaft 64 in the same direction as rope 60 was previously unwound.

Figure 5:
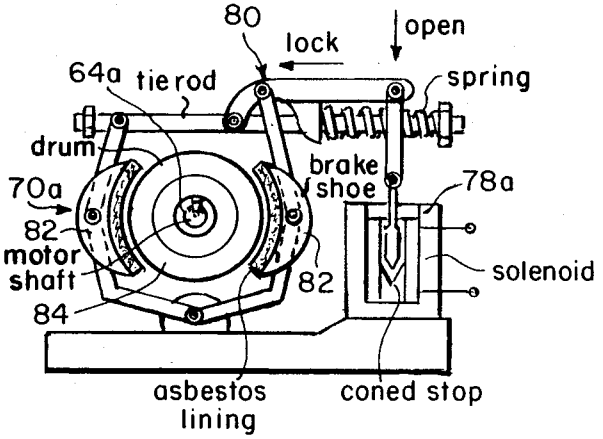
FIG. 5 Prior Art
FIG. 5 is a schematic view of a prior-art electromagnetic brake suitable for use in the practice of this invention.

FIG. 5 shows schematically an electromagnetic brake 70*a* of the prior art suitable to serve as brake 70 in descent control mechanism 40. As may be readily seen, solenoid 78*a*, through spring-maintained linkage means 80 and when current is supplied, moves brake shoes 82,82 against brake drum 84, thus checking the rotation af shaft 64*a*. In identical manner, electromagnetic brake 70 of mechanism 40 is actuated by solenoid 78 when current is applied thereto by speed control governor 68 closing the circuit between generator 66 and solenoid 78.

Figure 6:
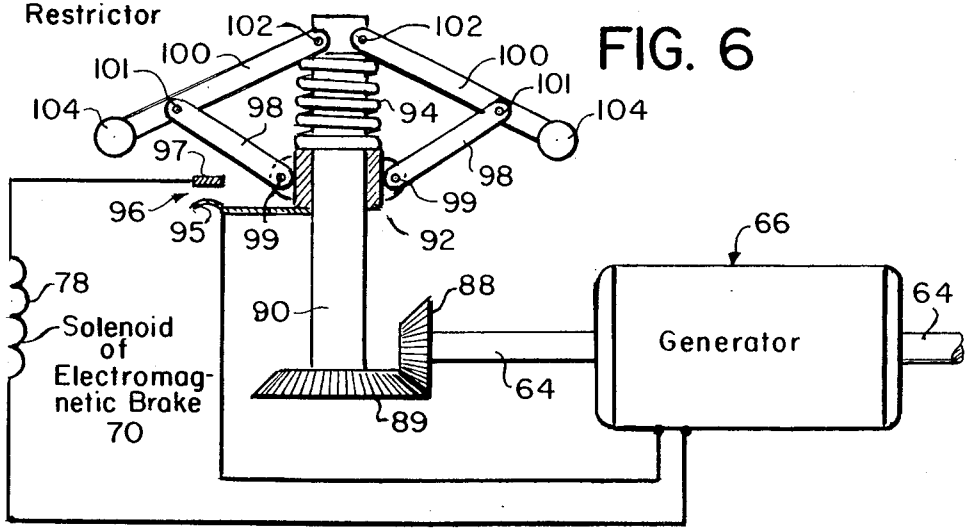
FIG. 6 is a diagrammatic view of a preferred speed control governor for use in the practice of this invention.

Speed control governor 68 may take the form of the centrifugal force device 86, illustrated diagrammatically in FIG. 6, wherein the rotation of horizontal main shaft 64 is translated through bevel gears 88,89 to vertical shaft 90. Collar 92, mounted to be vertically slidable on shaft 90, is urged downwardly by compression spring 94 so that moving contact 95 of switch 96, supported by collar 92, is normally held away from fixed contact 97. A pair of oppositely disposed links 98,98 are pivotally mounted at one end each to opposite sides of collar 92 at 99,99, and each is pivotally mounted at its opposite end to a second pair of links 100,100 at 101,101. Links 100,100 are attached pivotally at 102,102 to shaft 64, and at their oposite ends weighted balls 104,104 are fixed.

When shaft 64 is rotated by spool 62, the motion is translated to shaft 90; as the rotary speed of shaft 90 increases, weights 104,104 are urged upwardly and outwardly by the centrifugal force generated by their rotation; as a result, collar 92, carrying movable contact 95, is urged upwardly against the force of spring 94. At a pre-adjusted point, when the rate of descent of escaper E has reached its allowable maximum, the speed of rotation of shfts 64 and 90 creates a centrifugal force large enough to raise collar 92 so that contact 95 is moved into switch-closing relationship with fixed contact 97. Thus, switch 96 closes the circuit between generator 66 and brake solenoid 78, energizing brake 70 into contact with shaft 64 and preventing a rotational speed beyond the chosen maximum from developing. It may be noted that the speed of descent is completely independent of the size or weight of the escaper.

Figure 7:
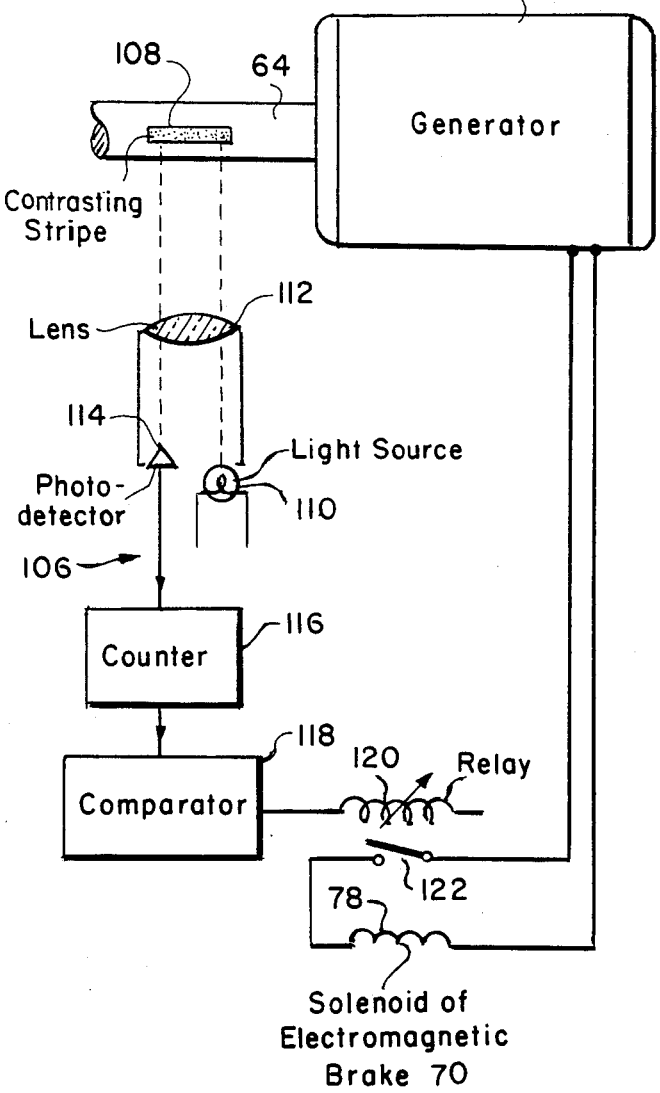
FIG. 7 is a diagrammatic view of an alternative preferred embodiment of a speed control governor.

An alternative speed control governor 106, which operates optically, is illustrated diagrammatically in FIG. 7. Here, main shaft 64 carries a marking such as a stripe of contrasting color 108, the rotation of which is observed and counted by device 106. The operation of device 106 involves light source 110 sending a beam of light through lens 112, which focuses the light beam on stripe 108. The reflected light beam passes again through lens 112, to be directed to photodetector 114, which passes the pulses generated thereby through counter 116 and on to comparator 118. When the rate of rotation of shaft 64 matches that pre-set in comparator 118, relay 120 is energized, closing both the switch 122 and the circuit between generator 66 and brake solenoid 78. Brake 70 is thereby applied to shaft 64, preventing too rapid turning of shaft 64 and too rapid descent of escaper E.

A few embodiments of this invention have been described as illustrative examples; it will be apparent to those skilled in the art that various substitutions or modifications may be made without departing from the spirit of this invention or the scope of the appended claims.

What is claimed is:

1. Window escape descent control device for lowering an escaper from an upper window of a high building at a safe predetermined maximum rate of descent, which comprises:

body support means for holding the escaper securely during the descent from window to ground;

a main rope attached to said body support means, said main rope being of sufficient length to reach from window to ground;

a spool on which said main rope is wound;

a shaft coaxially carrying, and for simultaneous rotation with, said spool;

speed control means operatively mounted on said shaft for governing the maximum speed of rotation of said shaft when said spool is rotated by the unwinding of said main rope from said spool by the weight of the descending escaper; and frame support means to be secured on the ledge of the escape window for providing mounting for said speed control means, said spool and said shaft, said frame means also providing hand and foot supports to aid the escaper in emerging from the window and positioning himself for descent.

2. Window escape descent control device in accordance with claim 1, wherein said body support is a harness which comprises:

an adjustably secured waist-encircling belt;

a second belt supporting the upper body extending around the chest and under the arms of the escaper;

a support rope connecting the rear portions of said waist belt and said second belt; and means for connecting said second belt and said support rope to said main rope.

3. Window escape descent control device as defined by claim 1, wherein said spool is provided with one-way rotation control means for said main shaft to be turned by the rotation of said spool in only one direction.

4. Window escape descent control device as defined by claim 1, wherein said spool comprises a stepped diameter rope-winding portion to alter the amount of said main rope being unwound per revolution of said spool.

5. Window escape descent control device in accordance with claim 1, wherein said speed control means comprises:

a generator mounted operatively on said shaft for converting the rotational energy from said shaft to electrical energy;

electromagnetic brake means operatively mounted on said shaft for slowing the rotation of said shaft when said brake means is energized by the electrical energy supplied by said generator; and speed governing means operatively connected to said shaft for actuating said electromagnetic brake by closing the circuit between said generator and said brake when the rotation of said shaft reaches a pre-determined maximum speed.

6. Window escape descent control device in accordance with claim 5, wherein said speed governing means comprises a centrifugally activated mechanism operated by the rotation of said shaft for controlling the closing of a circuit-completing switch by centrifugal force.

7. Window escape descent control device as defined by claim 5, wherein said speed governing means is optically controlled.

8. Window escape descent control device as defined by claim 1, further comprising means for rewinding said main rope on said spool to permit the descent control device to be used by another escaper after the first escaper has reached the ground.

9. Window escape descent control device as defined by claim 1, wherein said frame means further comprises:

adjustment means for permitting said frame support means to be mounted firmly on the window ledge and against the building wall extending below the escape window; and said frame support means being formed from a plurality of pivotally connected sections to be folded on one another for facilitating storage of the window escape descent control device.

* * * * *